US007575026B2

(12) United States Patent
Boeck

(10) Patent No.: US 7,575,026 B2
(45) Date of Patent: Aug. 18, 2009

(54) PAPER MACHINE MESH

(75) Inventor: Johann Boeck, Neufelden (AT)

(73) Assignee: Voith Patent GmbH, Heidenheim (DE)

( * ) Notice: Subject to any disclaimer, the term of this patent is extended or adjusted under 35 U.S.C. 154(b) by 407 days.

(21) Appl. No.: 11/560,033

(22) Filed: Nov. 15, 2006

(65) Prior Publication Data

US 2007/0113914 A1 May 24, 2007

(30) Foreign Application Priority Data

Nov. 21, 2005 (DE) ..... 10 2005 055 785

(51) Int. Cl.

| | |
|---|---|
| ***D21F 1/10*** | (2006.01) |
| ***D21F 7/08*** | (2006.01) |
| *D03D 23/00* | (2006.01) |
| *D03D 25/00* | (2006.01) |

(52) U.S. Cl. ..... 139/383 A; 139/383 AA; 139/383 R; 162/358.1; 162/358.2

(58) Field of Classification Search ..... 139/383 R, 139/383 A, 383 AA, 408, 411, 412, 413, 139/414; 162/348, 358.1, 358.2, 900, 902, 162/903, 904

See application file for complete search history.

(56) References Cited

U.S. PATENT DOCUMENTS

| | | | | | |
|---|---|---|---|---|---|
| 4,815,499 | A | * | 3/1989 | Johnson | 139/383 A |
| 4,909,284 | A | * | 3/1990 | Kositzke | 139/383 A |
| 4,989,647 | A | * | 2/1991 | Marchand | 139/383 A |
| 4,998,568 | A | * | 3/1991 | Vohringer | 139/383 A |
| 5,067,526 | A | * | 11/1991 | Herring | 139/383 A |
| 5,092,372 | A | * | 3/1992 | Fitzka et al. | 139/383 A |
| 5,151,316 | A | | 9/1992 | Durkin et al. | 428/213 |
| 5,152,326 | A | * | 10/1992 | Vohringer | 139/383 A |
| 5,437,315 | A | * | 8/1995 | Ward | 139/383 A |

(Continued)

FOREIGN PATENT DOCUMENTS

| | | |
|---|---|---|
| DE | 29724238 | 9/2000 |

(Continued)

*Primary Examiner*—Bobby H Muromoto, Jr.
(74) *Attorney, Agent, or Firm*—Taylor & Aust, P.C.

(57) ABSTRACT

A paper machine mesh, in particular a forming mesh including: an upper fabric layer including upper transverse threads, the outer side of which forms a paper side of the paper machine mesh; a lower fabric layer including lower transverse threads, the outer side of which forms a machine side of the paper machine mesh; and tie threads, arranged in pairs and extending transverse to the transverse threads, which connect the upper and the lower fabric layer to each other in that the tie threads of each pair are woven with upper transverse threads to form upper tie sections and with lower transverse threads to form lower tie sections, wherein each upper tie section is formed by weaving one tie thread of the pair with one or more consecutive upper transverse threads and an upper tie section of the other tie thread of the pair is arranged between two consecutive upper tie sections of the tie thread, wherein in the case of each upper tie section the tie thread crosses at least one upper transverse thread when a tie thread runs on the outer side of the upper fabric layer, and wherein in the case of each lower tie section one tie thread crosses at least one lower transverse thread when it runs on the outer side of the lower fabric layer, and with a repeat in which the weaving pattern of the paper machine mesh is repeated.

26 Claims, 3 Drawing Sheets

U.S. PATENT DOCUMENTS

| | | | | |
|---|---|---|---|---|
| 5,454,405 | A * | 10/1995 | Hawes | 139/383 A |
| 5,465,764 | A * | 11/1995 | Eschmann et al. | 139/383 A |
| 5,487,414 | A * | 1/1996 | Kuji et al. | 139/383 A |
| 5,544,678 | A * | 8/1996 | Barrett | 139/383 A |
| 6,854,488 | B2 * | 2/2005 | Hay et al. | 139/383 A |
| 6,860,969 | B2 | 3/2005 | Troughton | 162/348 |
| 7,124,781 | B2 | 10/2006 | Fahrer et al. | 139/383 |
| 7,249,615 | B2 * | 7/2007 | Westerkamp et al. | 139/383 A |
| 7,415,993 | B2 * | 8/2008 | Hay et al. | 139/383 A |
| 2004/0118473 | A1 * | 6/2004 | Hay et al. | 139/383 R |
| 2004/0238063 | A1 * | 12/2004 | Stone | 139/383 A |
| 2005/0103397 | A1 * | 5/2005 | Quigley et al. | 139/383 A |
| 2006/0016508 | A1 * | 1/2006 | Westerkamp et al. | 139/383 R |
| 2006/0016509 | A1 * | 1/2006 | Westerkamp et al. | 139/383 R |
| 2008/0105323 | A1 * | 5/2008 | Hay et al. | 139/383 A |

FOREIGN PATENT DOCUMENTS

| | | |
|---|---|---|
| EP | 0100197 | 2/1984 |
| EP | 0432413 | 10/1990 |
| WO | WO 2004/061211 | 7/2004 |
| WO | WO 2004/111333 | 12/2004 |

* cited by examiner

PAPER MACHINE MESH

BACKGROUND OF THE INVENTION

1. Field of the Invention

This invention relates to a paper machine mesh, in particular a forming mesh.

2. Description of the Related Art

Forming meshes are used in the forming section of a paper machine. During the forming process, a fiber suspension from the headbox of the paper machine is applied to one forming mesh or to two forming meshes (in the case of gap formers). In this case, the forming mesh is to dewater the fiber suspension and is to form a fibrous web, wherein as little cellulose fiber and filler material as possible should be separated from the fiber suspension during the dewatering process.

The quality of the formed fibrous web is co-defined in this case to a great extent by the structure of the surface of the forming mesh facing the fibrous web (paper side). The life of the forming mesh, on the other hand, is greatly influenced by the structure of the surface of the forming mesh facing the paper machine (machine side).

To be able to take account of these in part contradictory requirements, multilayer paper machine meshes with a paper-side fabric layer and a machine-side fabric layer were developed, wherein the two fabric layers are connected to each other by so-called ties.

In the case of multilayer fabrics where the fabric layers are held together by separate ties, meaning by ties which form no integral part of the weave structure of at least the paper-side fabric layer, the tie points often cause depressions on the paper side, resulting in markings on the paper produced on such meshes.

In the case of multilayer fabrics where ties form an integral part of the weave structure, the tie points often provide only little tying strength between the fabric layers in return for as flat a paper side as possible. On the one hand the minimal connection between the fabric layers results on the one hand in a large thickness of the mesh, on the other hand it leads to a relative movement of the two fabric layers to each other during operation of the mesh.

The large thickness causes a high degree of water entrainment. Furthermore, a large mesh thickness increases the resistance to dewatering, which results in a poor dewatering of the paper web, which in turn has a disadvantageous effect in particular for high-speed paper machines because the paper web at the end of the dewatering section has too high a water content.

Through the relative movement of the two fabric layers to each other, the layers are worn down against each other, thus shortening the life of the mesh.

Multilayer forming meshes are known from EP 0 432 413 B1, DE 297 24 238 U1, EP 1 00 197 B1, WO 2004/061211A2 and U.S. 2004/0149342 A1 for example.

What is needed in the art is a paper machine mesh on which the connection between the paper-side and machine-side fabric layers is increased without the flatness of the paper-side fabric layer being negatively influenced.

SUMMARY OF THE INVENTION

A paper machine mesh, in particular a forming mesh, can have an upper fabric layer including upper transverse threads, the outer side of which forms a paper side of the paper machine mesh, and a lower fabric layer including lower transverse threads, the outer side of which forms a machine side of the paper machine mesh. Furthermore, a machine mesh can have tie threads, arranged in pairs and extending transverse to the transverse threads, which connect the upper and the lower fabric layer to each other in that the tie threads of each pair are woven with upper transverse threads to form upper tie sections and with lower transverse threads to form lower tie sections. In this case, each upper tie section is formed by weaving one tie thread of the pair with one or more consecutive upper transverse threads, wherein arranged between two consecutive upper tie sections of the tie thread there is one upper tie section of the other tie thread of the pair. In the case of each upper tie section, one tie thread crosses in addition at least one upper transverse thread when the tie thread runs on the outer side of the upper fabric layer. In the case of each lower tie section, one tie thread crosses at least one lower transverse thread when it runs on the outer side of the lower fabric layer. In addition, the mesh has tie thread repeats in which the weaving of the tie threads respectively with the upper and lower transverse threads is repeated.

The paper machine mesh of the present invention is characterized in that arranged in each tie thread repeat are more than two consecutive upper tie sections.

With more than two consecutive upper tie sections being arranged over the length of the tie thread repeat, a mesh with a considerably higher number of tie sections on the paper side compared to the prior art is created, wherein the tie frequency between the upper and the lower fabric layer is notably increased, thus leading to an improved connection of the lower fabric layer to the upper fabric layer. Through the increase in the number of upper or paper-side tie sections, their length is also shortened, thus leading to an improved flatness of the upper fabric layer because the individual upper tie sections are unable, on account of their shortness, to arch in relation to the lower fabric layer because a multiplicity of the tie sections are bilaterally connected via lower tie sections to the lower fabric layer.

According to an embodiment of the present invention, provision is made for four or more, in particular six upper tie sections to be arranged over the length of the tie thread repeat. A good connection of the upper fabric layer to the lower fabric layer is thus assured.

A low tendency to marking of the paper side is promoted in addition by the weave pattern of the upper fabric layer being a linen bond.

The weaving paths of the two tie threads of the pair differ from each other only in as much as they are offset from each other by a number of upper transverse threads, wherein the weaving paths of the two tie threads of a pair are offset from each other by half of the tie thread repeat. The advantage of this arrangement is that each tie thread of the pair weaves the weaving path with the upper and lower transverse threads in one half of the tie thread repeat while the other of the two tie threads weaves respectively in the other half of the tie thread repeat. Hence both repeat halves are mutually symmetrical with regard to the tie thread runs, thus resulting inter alia in a symmetrically distributed connection of the two fabric layers and prevention of the tendency to marking caused due to a non-symmetrical distribution of the tie sections as is the case with the mesh disclosed in EP100197B1 for example.

In addition, an embodiment of the present invention provides for the weaving of each tie thread with the upper transverse threads to form first upper tie sections with respectively at least one upper transverse thread and second upper tie sections with respectively at least one upper transverse thread.

The second upper tie sections in this case include more consecutive upper transverse threads than the first upper tie sections.

In this case a strong connection of the upper fabric layer to the lower fabric layer is effected by the shorter first tie sections.

The second tie sections include three consecutive upper transverse threads, wherein the tie thread on the outer side continually crosses the first and the third of the upper transverse threads and wherein the tie thread between the upper fabric layer and the lower fabric layer continually crosses the second of the upper transverse threads.

A concrete embodiment of the present invention provides for two first upper tie sections and four second upper tie sections to be arranged over the length of the tie thread repeat, wherein their order is in particular as follows:

1. a first tie section;
2. a second tie section;
3. a second tie section;
4. a first tie section;
5. a second tie section; and
6. a second tie section.

Provision is made for consecutive second upper tie sections formed by a tie thread of the pair between which the tie thread is not woven with lower transverse threads, wherein between consecutive second upper tie sections the tie thread continually crosses several, such as three, upper transverse threads between the upper and the lower fabric layer. This results in a floating of the tie thread between the upper and the lower fabric layer, by way of which the mesh is stiffened.

Provision is made in addition, between the second upper tie sections formed by the weaving of the one tie thread, for the other tie thread of the pair to form a first upper tie section by weaving with at least one upper transverse thread, wherein the first upper tie section is arranged between lower tie sections which are formed by the same tie thread of the pair. This results in a strong connection of the upper fabric layer to the lower fabric layer by the tie thread. As the result of the floating of the other tie thread of the pair between the second upper tie sections, the first upper tie section of the tie thread, which is arranged between the second upper tie points of the other tie thread, is supported, as the result of which the first upper tie section is not pulled in the direction of the lower fabric layer. The force for supporting the floating is absorbed in this case at least in part by the two second upper tie sections. This results in a strong connection of the two fabric layers and simultaneously in a flat paper side.

Provision is made in addition for consecutively arranged first and second upper tie sections to be formed by weaving one tie thread of the pair with upper and lower transverse threads, between which one lower tie section is arranged. The adjacent first and second tie sections formed by a tie thread are thus connected to each other by way of a lower tie section, thus resulting in a strong connection between the upper and lower fabric layer.

Each lower tie section is formed by weaving a tie thread with only one lower transverse thread.

Another embodiment of the present invention provides, when one tie thread of the pair is woven with upper transverse threads to form a second upper tie section, for the other tie thread of the pair to be woven with at least one lower transverse thread, which is arranged opposite the upper threads of the second upper tie section, to form a lower tie section. Hence the upper fabric layer, for example, is connected by a first upper tie section of a tie thread, which is arranged between two upper tie sections of the other tie thread, to the lower fabric layer above lower tie sections which are both arranged under the second upper tie sections of the other tie thread. This results in a uniform distribution of force in the connection between the two fabric layers, which means that the mesh is particularly thin and its paper side has a high degree of flatness.

To have as much scope as possible in forming the mesh of the invention, a further aspect of the present invention provides for a tie thread repeat, in which the weaving of a tie thread with upper and lower transverse threads is repeated, to include 40 transverse threads.

Also, the ratio of the upper transverse threads to the lower transverse threads can be 1:1.

In addition to weaving the tie threads with the upper transverse threads it is possible for the upper fabric layer to be formed by upper longitudinal threads extending in tie thread direction, which are woven only with upper transverse threads. Furthermore, in addition to weaving the tie threads with the lower transverse threads it is possible for the lower fabric layer to be formed by lower longitudinal threads extending in the tie thread direction, which are woven only with lower transverse threads.

A concrete embodiment of the present invention provides for the transverse threads to be warp threads and for the tie threads or longitudinal threads to be weft threads.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
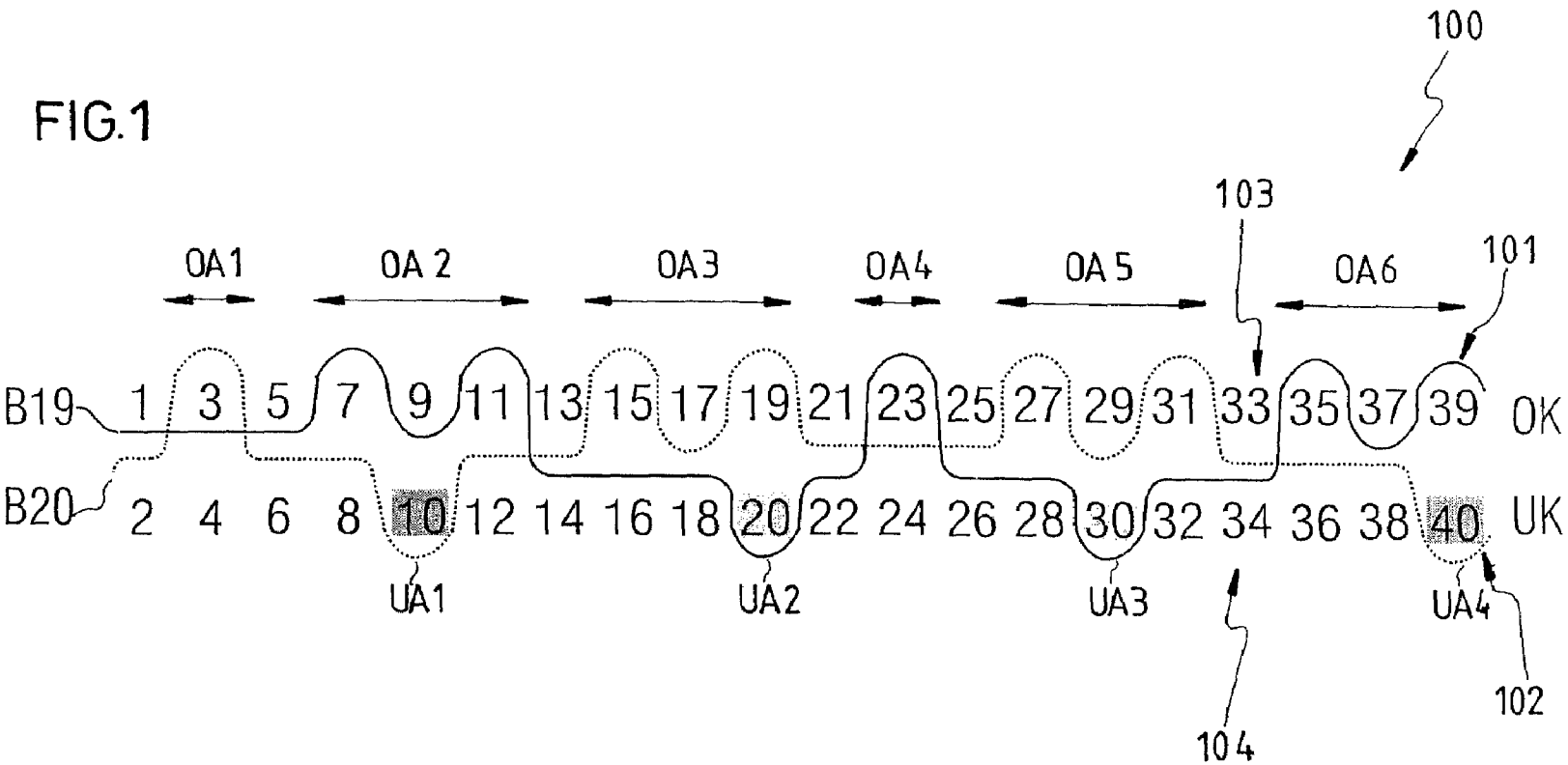
FIG. 1 shows, in the tie thread direction, a complete repeat of a paper machine mesh according to the present invention.
Figure 2:
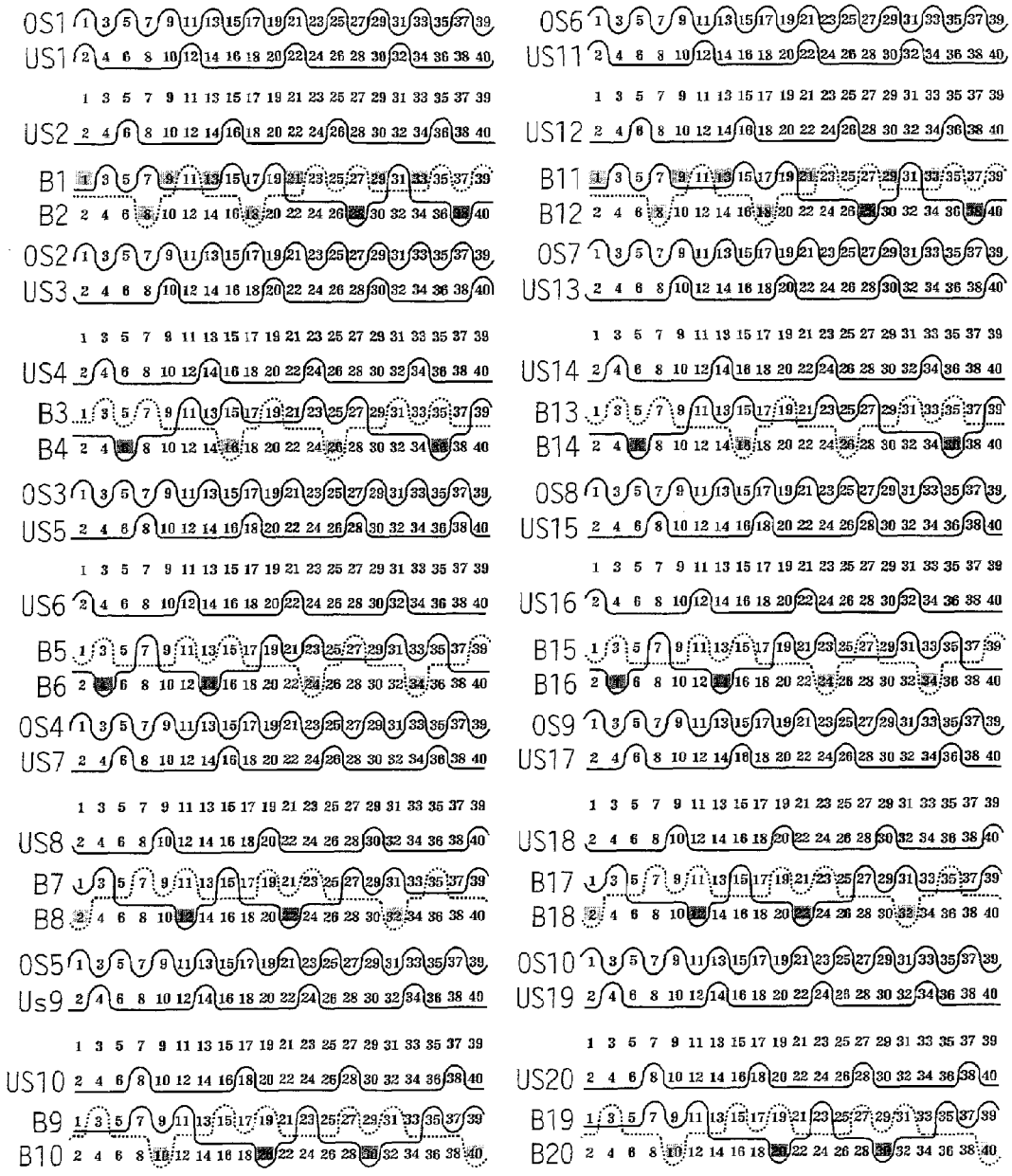
FIG. 2 shows a tie thread run of a tie thread pair of the paper machine mesh in FIG. 1.

Referring now to the drawings, and more particularly to FIG. 1, there is shown a complete repeat of an embodiment of a paper machine mesh 100, according to the present invention, constructed as a forming mesh. FIG. 2 shows a tie thread run of a tie thread pair of the mesh 100.

The forming mesh 100 includes an upper fabric layer 101 with an outer side 103 forming the paper side and a lower fabric layer 102 with an outer side 104 forming the machine side.

In the embodiment shown, the upper fabric layer 101 is formed by weaving tie threads B1 to B20, which are arranged in pairs, with the upper transverse threads OK1, OK3, OK5, OK7, . . . to OK 39, and by weaving upper longitudinal threads OS1 to OS10 with the upper transverse threads OK1, OK3, OK5, OK7, . . . to OK 39 (the right-side designations "OK" and "UK" in FIG. 2 will be used as representative for all upper and lower transverse threads respectively).

Furthermore, the lower fabric layer 102 is formed by weaving the tie threads B1 to B20, which are arranged in pairs, with lower transverse threads UK2, UK4, UK6, UK8,. . . , UK40, and by weaving lower longitudinal threads US1 to US20 with the lower transverse threads UK2, UK4, UK6, UK8, . . . , UK40.

One repeat unit of the embodiment includes accordingly 20 tie threads, 30 upper and lower longitudinal threads and 40 upper and lower transverse threads. The ratio of the upper transverse threads to lower transverse threads is 1:1.

Furthermore, the weave pattern of the upper fabric layer 101 forms a linen bond.

By way of example, the present invention will be explained essentially with reference to the runs of the tie threads B19 and B20 in FIG. 2.

The tie threads B1 to B20 and the longitudinal threads OS1 to OS10 and US1 to US20 extend in this case transverse to the upper and lower transverse threads.

By way of the tie threads Bl9 and B20, the upper fabric layer 101 and the lower fabric layer 102 are connected to each other by the tie threads B19 and B20 of each pair being woven with upper transverse threads OK1, OK3, OK5, OK7, . . . to OK 39 to form upper tie sections OA1 to OA6 and with lower transverse threads UK2, UK4, UK6, UK8 . . . , UK40 to form lower tie sections UA1 to UA4, wherein each upper tie section OA1 to OA6 is formed by weaving one tie thread B19, B20 of the pair with one or more consecutive upper transverse threads OK1, OK3, OK5, OK7, . . . to OK 39 and an upper tie section of the other tie thread of the pair being arranged between two consecutive upper tie sections of the tie thread. Between the consecutive upper tie sections OA2 and OA4 of the tie thread B19, for example, is arranged the upper tie section OA3 of the tie thread B20.

In the case of the forming mesh 100 shown, the transverse threads OK1, OK3, OK5, OK7, . . . to OK 39 and UK2, UK4, UK6, UK8, . . . , UK40 are warp threads and the tie threads B19 and B20 are weft threads.

An upper tie section OA1 to OA6 is formed in this case by a tie thread B19, B20 on the outer side 103 of the upper fabric layer 101 continually crossing at least one of the upper transverse threads OK1, OK3, OK5, OK7, . . . to OK 39.

The upper tie sections OA2 and OA6, for example, are formed by weaving respectively three consecutive upper transverse threads (OK7 to OK11 in the case of OA2 and OK35 to OK39 in the case of OA6) with the tie thread B19, wherein the tie thread B19 on the outer side 103 of the upper fabric layer 101 continually crosses the first and the third of the upper transverse threads and wherein the tie thread B19 between the upper fabric layer 101 and lower fabric layer 102 continually crosses the second of the upper transverse threads.

The upper tie sections OA3 and OA5 are formed furthermore by weaving the tie thread B20 with respectively three consecutive transverse threads (OK15 to OK19 in the case of OA3 and OK27 to OK31 in the case of OA5).

The upper tie sections OA2, OA3, OA5 and OA6 represent second upper tie sections.

Furthermore, first upper tie sections OA1 and OA4 are formed by weaving respectively one upper transverse thread (OK3 in the case of OA1 and OK23 in the case of OA4) with the tie thread B20 or B19.

As is evident in particular from FIG. 2, the weave pattern of the paper machine mesh 100 is repeated in a repeat OK1 to OK39 and UK2 to UK40, which extends in tie thread direction over the length of the repetition of the weaving path of one of the tie threads B19 or B20. According to the present invention, more than two upper tie sections, in the concrete case six upper tie sections OA1 to OA6, are arranged consecutively over the length of the repeat OK1 to OK39 and UK2 to UK40 in the tie thread direction.

The forming mesh 100 includes in addition lower tie sections UA1 to UA4, wherein at each lower tie section UA1 to UA4 one tie thread B19, B20 crosses at least one lower transverse thread when the tie thread B19, B20 runs on the outside 104 of the lower fabric layer 102.

As is evident in particular from FIG. 2, the weaving paths of the two tie threads B19, B20 of the pair differ from each other only in as much as they are offset from each other by a number of upper transverse threads, namely by the upper transverse threads OK5 to OK23, which corresponds to half of the tie thread repeat.

As is also evident from FIG. 1, the forming mesh 100 includes consecutive second upper tie sections formed by one tie thread of the pair, between which the tie thread is not woven with lower transverse threads. For example, the tie thread B20 between the second upper tie sections OA3 and OA5 that are formed by it is not woven with lower transverse threads UA; rather the tie thread B20 between the consecutive second upper tie sections OA3 and OA5 between the upper fabric layer 101 and lower fabric layer 102 continually crosses the three consecutive upper transverse threads OK21 to OK25.

Furthermore, arranged between the consecutive upper tie sections is a first upper tie section constructed by weaving the other tie thread with an upper transverse thread of the pair. For example, arranged between the two second upper tie sections OA3 and OA5 of the tie thread B20 is the first upper tie section OA4 constructed by weaving the tie thread B19 with the upper transverse thread OK23.

Furthermore, the forming mesh 100 includes consecutive first and second tie sections of a tie thread, between which a lower tie section of the same tie thread is arranged. For example, the second upper tie section OA3 of the tie thread B20 follows the first tie section OA1 of the tie thread B20, wherein arranged between the two upper tie sections OA1 and OA3 is the lower tie section UA1 of the tie thread B20.

The forming mesh 100 includes furthermore consecutive lower tie sections formed by one tie thread of the pair, between which the tie thread is woven with an upper transverse thread to form a first upper tie section. For example, arranged between the two lower tie sections UA2 and UA3 of the tie thread B19 is the first upper tie section OA4 of the tie thread B19 such that the first upper tie section arranged between the two second upper tie sections OA3 and OA5 is held bilaterally by the lower tie sections UA2 and UA3.

FIGS. 3*a* to 3*d* present respectively the run of a tie thread pair of more embodiments according to the present invention.

Figure 3:
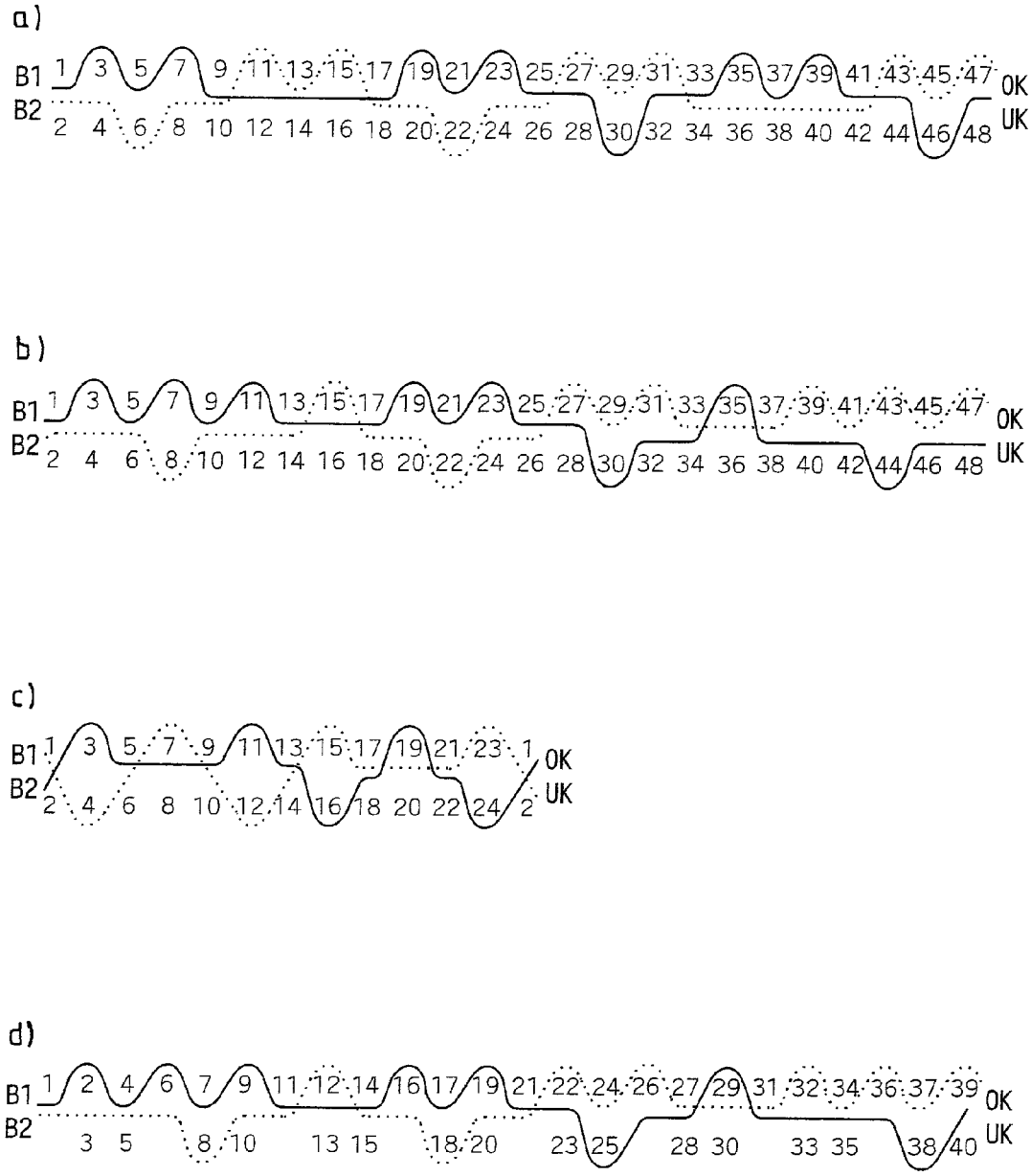
FIGS. 3*a*-3*d* each show a run of a tie thread pair according to the present invention.

In the case of the embodiment shown in FIG. 3*a*, provision is made for first and second upper tie sections, which include the same number of upper transverse threads, namely respectively three consecutive upper transverse threads.

In the case of the embodiment shown in FIG. 3*b*, the first upper tie sections include respectively one upper transverse thread, whereas the second upper tie sections of each tie thread include three and five consecutive upper transverse threads.

In the case of the embodiment shown in FIG. 3*c*, provision is made for first and second upper tie sections, which include the same number of upper transverse threads, namely respectively one upper transverse thread.

All the embodiments shown in the FIGS. 3*a-c* have a ratio of the upper to the lower transverse threads of 1:1.

The embodiment shown in FIG. 3*d* is similar to that of FIG. 3*b*, the essential difference being that it has a ratio of the upper to the lower transverse threads of 3:2.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine mesh comprising:

an upper fabric layer comprising a plurality of upper transverse threads and an outer side forming a paper side of the paper machine mesh;

a lower fabric layer comprising a plurality of lower transverse threads and an outer side forming a machine side of the paper machine mesh;

a plurality of tie threads arranged in a plurality of pairs and extending transverse to said plurality of upper and lower transverse threads, said plurality of tie threads connecting said upper and said lower fabric layers to each other in that said plurality of tie threads of each of said plurality of pairs are woven with said plurality of upper transverse threads to form a plurality of upper tie sections and with said plurality of lower transverse threads to form a plurality of lower tie sections, wherein each of said plurality of upper tie sections is formed by weaving one of said plurality of tie threads of one of said plurality of pairs with at least one consecutive said plurality of upper transverse threads and one of said plurality of upper tie sections of another of said plurality of tie threads of said one of said plurality of pairs is arranged between two consecutive said plurality of upper tie sections of said one of said plurality of tie threads, wherein each of said plurality of upper tie sections comprises one of said plurality of tie threads crossing at least one of said plurality of upper transverse threads when said one of said plurality of tie threads runs on said outer side of said upper fabric layer, and wherein each of said plurality of lower tie sections comprises one of said plurality of tie threads crossing at least one of said plurality of lower transverse threads when said one of said plurality of tie threads runs on said outer side of said lower fabric layer;

a plurality of tie thread repeats in which a weaving of said plurality of tie threads respectively with said plurality of upper and lower transverse threads is repeated; and more than two consecutive said plurality of upper tie sections are arranged in each of said plurality of tie thread repeats.

2. The paper machine mesh according to claim 1, wherein at least four of said plurality of upper tie sections are arranged in each of said plurality of tie thread repeats.

3. The paper machine mesh according to claim 1, wherein six of said plurality of upper tie sections are arranged in each of said plurality of tie thread repeats.

4. The paper machine mesh according to claim 1, wherein said upper fabric layer includes a weave pattern which is a linen bond.

5. The paper machine mesh according to claim 1, wherein said plurality of tie threads includes a plurality of weaving paths, each of said plurality of weaving paths of each of said plurality of tie threads of each of said plurality of pairs differs from each other only in as much as each of said plurality of weaving paths is offset from each other by a number of said plurality of upper transverse threads.

6. The paper machine mesh according to claim 5, wherein each of said plurality of weaving paths of each of said plurality of tie threads of each of said plurality of pairs are offset from each other by half of one of said plurality of tie thread repeats.

7. The paper machine mesh according to claim 1, wherein said weaving of each of said plurality of tie threads with said plurality of upper transverse threads forms a first plurality of upper tie sections with respectively at least one of said plurality of upper transverse threads and a second plurality of upper tie sections with respectively at least one of said plurality of upper transverse threads.

8. The paper machine mesh according to claim 7, wherein said second plurality of upper tie sections comprises more consecutive said plurality of upper transverse threads than said first plurality of upper tie sections.

9. The paper machine mesh according to claim 8, wherein said first plurality of upper tie sections comprises one of said plurality of upper transverse threads and said second plurality of upper tie sections comprises two or more consecutive said plurality of upper transverse threads.

10. The paper machine mesh according to claim 8, wherein said second plurality of upper tie sections comprises three consecutive said plurality of upper transverse threads, said three consecutive plurality of upper transverse threads including a first, a second, and a third upper transverse thread, wherein said plurality of tie threads on said outer side of said upper fabric layer continually crosses said first and said third upper transverse threads, and wherein said plurality of tie threads between said upper fabric layer and said lower fabric layer continually crosses said second upper transverse thread.

11. The paper machine mesh according to claim 8, wherein two of said first plurality of upper tie sections and four of said second plurality of upper tie sections are arranged over a length of each of said plurality of tie thread repeats.

12. The paper machine mesh according to one of the claims 8, wherein consecutive said second plurality of upper tie sections comprises one of said plurality of tie threads of one of said plurality of pairs, between said consecutive second plurality of upper tie sections said one of said plurality of tie threads being not woven with said plurality of lower transverse threads.

13. The paper machine mesh according to claim 12, wherein between said consecutive second plurality of upper tie sections said one of said plurality of tie threads continually crosses several of said plurality of upper transverse threads between said upper and said lower fabric layer.

14. The paper machine mesh according to claim 12, wherein between said consecutive second plurality of upper tie sections said one of said plurality of tie threads continually crosses three of said plurality of upper transverse threads between said upper and said lower fabric layer.

15. The paper machine mesh according to claim 12, wherein between said plurality of upper tie sections another of said plurality of tie threads of said one of said plurality of pairs forms one of said first plurality of upper tie sections by weaving with at least one of said plurality of upper transverse threads.

16. The paper machine mesh according to claim 12, wherein said first and said second plurality of upper tie sections arranged consecutively are formed by weaving one of said plurality of tie threads of one of said plurality of pairs with said plurality of upper and said plurality of lower transverse threads, between which one of said plurality of lower tie sections is arranged.

17. The paper machine mesh according to claim 12, wherein consecutive said plurality of lower tie sections comprise one of said plurality of tie threads of one of said plurality of pairs, between said consecutive plurality of lower tie sections said one of said plurality of tie threads being woven with one of said plurality of upper transverse threads to form one of said plurality of first upper tie sections.

18. The paper machine mesh according to claim 17, wherein said plurality of lower tie sections are formed by weaving said plurality of tie threads with only one of said plurality of lower transverse threads.

19. The paper machine mesh according to claim 18, wherein when one of said plurality of tie threads of one of said plurality of pairs is woven with said plurality of upper transverse threads to form one of said plurality of upper tie sections, another of said plurality of tie threads of said one of said plurality of pairs is woven with a plurality of lower transverse threads to form one of said plurality of lower tie sections.

20. The paper machine mesh according to claim 1, wherein one of said plurality of tie thread repeats comprises 40 transverse threads.

21. The paper machine mesh according to claim 1, wherein said plurality of upper transverse threads to said plurality of lower transverse threads comprises a ratio of 1:1.

22. The paper machine mesh according to claim 1, wherein at least one of said upper fabric layer comprises a plurality of upper longitudinal threads extending in a direction of said plurality of tie threads, said plurality of upper longitudinal threads being woven only with upper transverse threads, and said lower fabric layer comprises a plurality of lower longitudinal threads extending in said direction of said plurality of tie threads, said plurality of lower longitudinal threads being woven only with lower transverse threads.

23. The paper machine mesh according to claim 22, wherein a quantity of lower longitudinal threads is greater than a quantity of upper longitudinal threads.

24. The paper machine mesh according to claim 23, wherein said quantity of upper longitudinal threads is 10 and said quantity of lower longitudinal threads is 20.

25. The paper machine mesh according to claim 22, wherein said quantity of lower longitudinal threads is twice as many as said quantity of upper longitudinal threads.

26. The paper machine mesh according to claim 22, wherein said plurality of upper and lower transverse threads comprise a plurality of transverse threads, said plurality of upper and lower longitudinal threads comprise a plurality of longitudinal threads, said plurality of transverse threads comprise a plurality of warp threads, and one of said plurality of tie threads and said plurality of longitudinal threads comprise a plurality of weft threads.

* * * * *